United States Patent [19]

Bennett et al.

[11] Patent Number: 4,653,572

[45] Date of Patent: Mar. 31, 1987

[54] DUAL-ZONE BOILING PROCESS

[75] Inventors: Douglas L. Bennett; Alexander Schwarz, both of Allentown; Robert M. Thorogood, Macungie, all of Pa.

[73] Assignee: Air Products and Chemicals, Inc., Allentown, Pa.

[21] Appl. No.: 838,483

[22] Filed: Mar. 11, 1986

[51] Int. Cl.[4] ..... F28F 13/18

[52] U.S. Cl. ..... 165/1; 165/133; 165/146; 165/911; 62/52; 122/367 C

[58] Field of Search ..... 165/133, 146, 1, 183, 165/179, 147, 911; 122/367 C; 62/52

[56] References Cited

U.S. PATENT DOCUMENTS

| | | | |
|---|---|---|---|
| 3,214,926 | 11/1965 | Shaievitz et al. | 62/14 |
| 3,457,990 | 7/1969 | Theophillos et al. | 165/133 |
| 3,630,276 | 12/1971 | Paine et al. | 165/133 X |

FOREIGN PATENT DOCUMENTS

| | | | |
|---|---|---|---|
| 59-46490 | 3/1984 | Japan | 165/133 |
| 2155612 | 9/1985 | United Kingdom | 165/133 |

OTHER PUBLICATIONS

Chu and Sealy, Snap-On Nucleate Boiling Premeter, I.B.M. Technical Disclosure Bulletin, 8-3-68.

O'Neill & Gottzmann, "Improved Air Plant Main Condenser", Union Carbide Corp.

*Primary Examiner*—Albert W. Davis, Jr.

*Assistant Examiner*—Richard R. Cole

*Attorney, Agent, or Firm*—Willard Jones, II; James C. Simmons; E. Eugene Innis

[57] ABSTRACT

The invention relates to a process and apparatus for boiling flowing liquid such as liquefied gases in a heat exchanger in which a circulating flow is occuring, such as in reboiler-condensers in air separation and similar cryogenic plants or other applications where a high efficiency for boiling heat transfer is beneficial. The important feature of the process and apparatus is the use of two sequential heat transfer zones having different pressure drop and heat transfer characteristics in the same boiling channel, the first zone having a higher pressure drop and high convective heat transfer characteristic and the second zone having a lower pressure drop and an enhanced nucleate boiling heat transfer characteristic.

22 Claims, 7 Drawing Figures

FIG. 1a
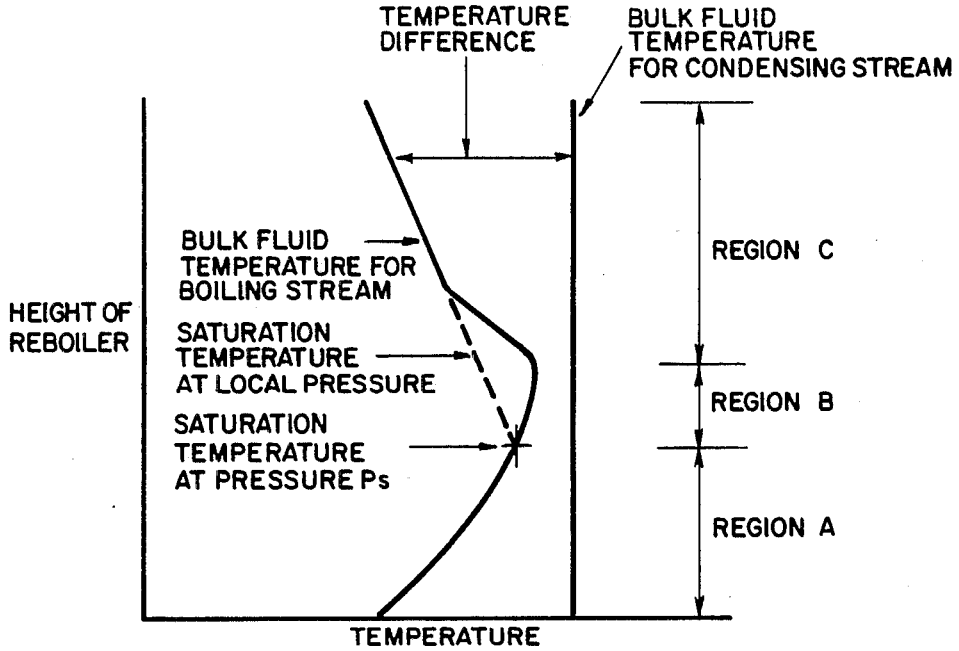
TEMPERATURE VARIATION WITH HEIGHT IN A THERMOSYPHON REBOILER-CONDENSER
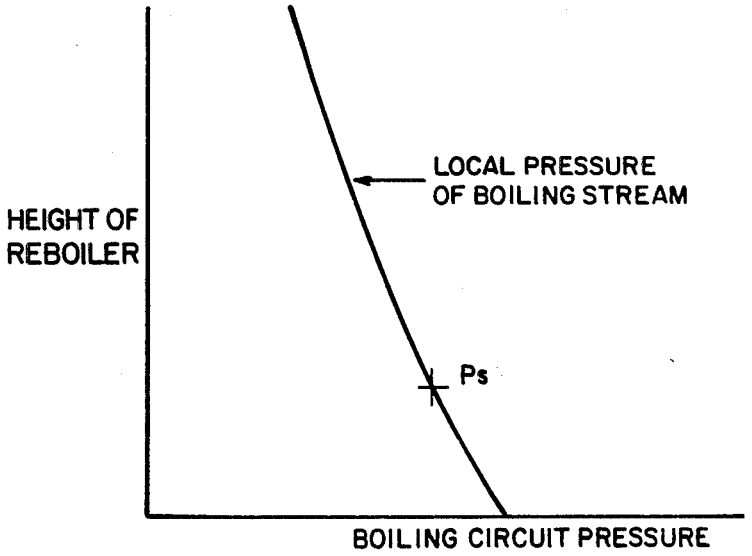
PRESSURE VARIATION WITH HEIGHT IN A THERMOSYPHON REBOILER-CONDENSER
FIG. 1b

COMPARISON OF PRESSURE GRADIENTS IN CONVENTIONAL AND DUAL-ZONE BOILING CHANNEL

*SINGLE ZONE BOILING CHANNEL*

*DUAL-ZONE BOILING CHANNEL*

DUAL-ZONE BOILING PROCESS

TECHNICAL FIELD

This invention relates to an improved method and apparatus for boiling flowing liquids such as liquefied gases in a heat exchanger in which a circulating flow is occurring, such as a thermosyphon heat exchanger for air separation or other cryogenic applications or other applications where a high efficiency for boiling heat transfer is beneficial.

BACKGROUND OF THE PRIOR ART

Various processes have been known and utilized in the prior art for reducing the temperature difference across a reboiler-condenser such as providing the maximum possible heat transfer surface area and/or by enhancing the heat transfer coefficient of the boiling and/or condensing fluid. Generally, in the heat transfer equipment used previously, two heat transfer process schemes have been employed. Both of these process arrangements have the condensing vapor entering at the top of the heat exchanger with the condensate flowing downwards under gravity to exit at the bottom.

One arrangement of the boiling process, termed downflow boiling, is to introduce the liquid at the top of the heat exchanger and allow it to boil while draining under gravity. This has the benefit of a small pressure change with height since the adverse effect of liquid head is largely eliminated. Thus, the boiling temperature of the liquid remains approximately constant along with the temperature difference between boiling and condensing fluids; this helps to maximize the efficiency of the reboiler-condenser. This arrangement has been used infrequently because of the difficulty of distributing liquid uniformly and the necessity to provide an external liquid pumping system to achieve sufficient liquid flow to ensure that the boiling liquid flows over the whole of the heat transfer surface. In an air separation plant, this is necessary for safety reasons as well as to maintain a high heat transfer performance of the boiling surface.

The more common heat transfer process places the heat exchanger in a bath of the boiling liquid so that the boiling surface is immersed. Vapor formed at the boiling surface rises due to buoyancy and carries liquid with it. This induces an upward circulating liquid flow through the boiling zone, with fresh liquid being drawn into the bottom of the zone and excess liquid being discharged at the top end and hence being recirculated to the bottom inlet. This process is termed thermosyphon boiling.

Various types of equipment are known for these above boiling processes. The earliest form was the shell and tube reboiler with boiling either inside or outside of the tubes and using either downflow of thermosyphon schemes. In one improvement the area for heat transfer was increased for the thermosyphon process, and thus the temperature difference reduced, by the introduction of the brazed aluminum reboiler.

In a typical heat exchanger of this design, aluminum plates, designated as parting sheets, 0.03 to 0.05 inches thick are connected by a corrugated aluminum sheet which serves to form a series of fins perpendicular to the parting sheets. Typically the fin sheets will have a thickness of 0.008 to 0.012 inches with 15 to 25 fins per inch and a fin height, the distance between parting sheets, of 0.2 to 0.3 inches. A heat exchanger is formed by brazing an assembly of these plates with the edges enclosed by side bars.

This exchanger is immersed in a bath of the liquid to be boiled with the parting sheets and the fins orientated vertically, Alternate passages separated by the parting sheets contain the boiling and condensing fluids. The liquid to be boiled enters the open bottom of the boiling passages and flows upward under thermosyphon action. The resulting heated mixture of liquid and vapor exits via the open top of the boiling passages. The vapor to be condensed is introduced at the top of the condensing passages through a manifold welded to the side of the heat exchanger and having openings into alternate passages. The resulting condensate leaves the lower end of the condensing passages through a similar side manifold. Special distributor fins, inclined at an angle to the vertical, are used at the inlet and outlet of the condensing passages. The upper and lower horizontal ends of the condensing passages are sealed with end bars.

Attempts to increase the effectiveness of both types of heat exchangers operating by the thermosyphon process have also been made by enhancement of the heat transfer coefficient. In the shell-and-tube heat exchanger, nucleate boiling promoters have been used consisting of a porous metal layer approximately 0.010 inch thick which is bonded metallurgically to the inner tube surface. Heat transfer coefficients in nucleate boiling are enhanced 10–15 fold over a corresponding bare surface. A combination of extended microsurface area and large numbers of stable re-entrant nucleation sites are responsible for the improved performance. The external tube surface is also enhanced for condensation by the provision of flutes on the surface.

Enhanced boiling heat transfer surface has also been applied to the brazed aluminum heat exchanger by scribing the primary boiling surface with many fine lines to promote nucleation. At the same time the boiling passage fins were eliminated. This type of reboiler is described in U.S. Pat. No. 3,457,990 of N. P. Theophilos and D. I-J. Wang.

In both of these types of enhanced reboiler-condensers a single type of heat transfer surface is used throughout the vertical height of the boiling circuit and thus the essentially uniform pressure gradient and varying temperature distribution of the single zone thermosyphon process is preserved with its attendant inefficiency.

BRIEF SUMMARY OF THE INVENTION

The present invention is directed to an improved process for boiling flowing liquids in a heat exchanger, the improvement comprising heating said flowing liquid in a heat exchanger having two sequential heat transfer zones of different characteristics in a single exchanger, said heat exchanger comprising: a first heat transfer zone comprising a surface with a high-convective-heat-transfer characteristic and a higher pressure drop characteristic; and a second heat transfer zone comprising an essentially open channel with only minor obstruction by secondary surfaces, with an enhanced nucleate boiling heat transfer surface and a lower pressure drop characteristic. In addition, the present invention is directed to an air separation process which incorporates the improved process for boiling flowing liquids for reboiler-condenser duty.

The present invention is also directed to an improved heat exchanger for boiling flowing liquids, the improvement of which comprises the incorporation of two sequential heat transfer zones of different characteristics in a single exchanger, said heat exchanger comprising: a first heat transfer zone comprising a surface with a high-convective-heat-transfer characteristic and a higher pressure drop characteristic; and a second heat transfer zone comprising an essentially open channel with only minor obstruction by secondary surfaces, with an enhanced nucleate boiling heat transfer surface and a lower pressure drop characteristic.

BRIEF DESCRIPTION OF THE DRAWINGS

FIG. 1*a* is a plot of the variation of temperature and temperature difference along the height of a boiling channel using a conventional, single zone, reboiler-condenser.

FIG. 1*b* is a plot of the variation of pressure along the height of a boiling channel using a conventional, single zone, reboiler-condenser.

DETAILED DESCRIPTION OF THE INVENTION

Figure 2:
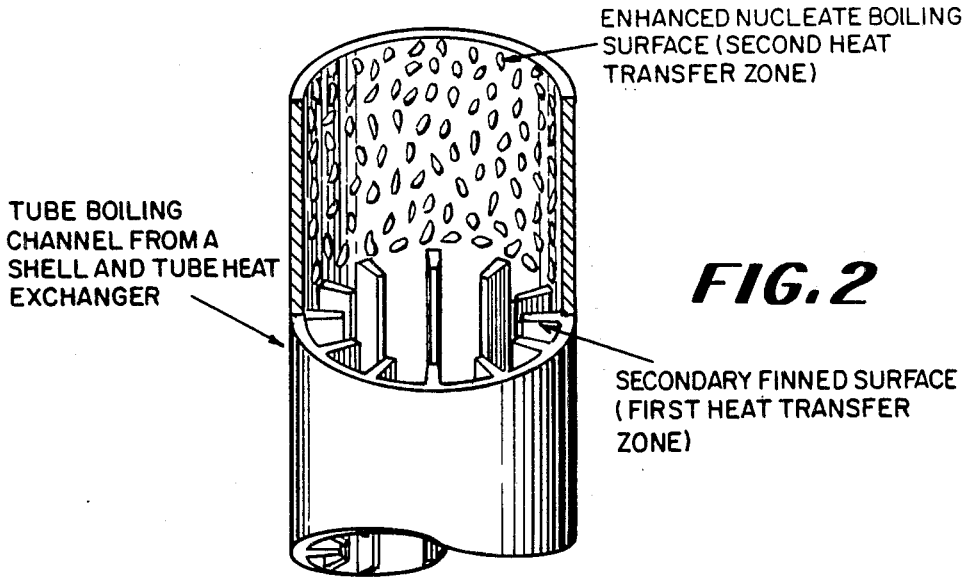
FIG. 2 is a perspective view of a tube in a shell and tube heat exchanger showing a first zone with internal fins as the secondary surface and a second zone with an enhanced nucleate boiling surface.

In the operation of a cryogenic air separation plant, such as the generally used double column design, as described in U.S. Pat. No. 3,214,926, the power consumption of the air compressor is related to the temperature difference between the oxygen being boiled in the low-pressure column and the nitrogen being condensed in the high-pressure column. Reduction of the temperature difference across this reboiler-condenser will permit reduction of the power consumption for the production of oxygen and nitrogen. Typically, a reduction of one degree Fahrenheit in the temperature difference at the top of the reboiler will permit a reduction of about 2.5% in air compression power. It is also important that the reboiler-condenser equipment should be compact and preferably able to fit entirely within the distillation column. This minimizes the cost of equipment, shipping and installation at the plant site. It is also necessary that these improvements should be effected in a completely safe manner, which in the particular instance of an air separation plant requires that boiling should occur without any possibility of total vaporization of liquid, i.e. dry out.

Therefore, it is the purpose of the present invention to reduce both power cost and capital cost associated with the air separation process. Similar benefits should be obtained in other processes where a reduction of heat transfer temperature difference in a compact device is required, especially in the cryogenic process industry; for example, in the processing of natural gas, hydrogen, helium and other gases where the cleanliness of the system permits the use of compact heat exchange equipment.

Prior to discussion of the present invention, it is important to examine the present solution to the above problem, thermosyphon boiling. The disadvantage of this process is that the pressure gradient throughout the boiling passage is relatively constant. Thus, the boiling temperature of the liquid changes considerably throughout the height of the boiling channel thereby causing a substantial variation in temperature difference between the condensing vapor on the one side of the exchanger and the boiling liquid on the other thereby reducing the efficiency of the heat exchanger. In addition, the liquid enters the bottom of the boiling zone at below its boiling temperature due to the increase in pressure by liquid head and must be increased in temperature, by less effective convective heat transfer, until it reaches its boiling temperature at a higher location in the boiling channel. The effect of this process is to produce a variation in boiling pressure, temperature and temperature difference with respect to height in the boiling channel as illustrated in FIGS. 1*a* and *b*.

With reference to FIG. 1*a*, three regions of heat transfer may be identified in the boiling channel. Region A is convective heat transfer which extends from the inlet of the boiling channel to the point ($P_s$) where the bulk temperature of the fluid equals the saturation temperature of the liquid at the local pressure. Region B, the liquid superheated region, is where the bulk temperature of the liquid exceeds the saturation temperature without boiling; this region occurs in the zone between the point ($P_s$) where the bulk temperature of the fluid equals the saturation temperature of the liquid at the local pressure until the point where full nucleation and vapor generation occurs. Region C exhibits nucleate and/or convective boiling with upwardly decreasing pressure and temperature.

The purpose of the present invention is to overcome the effect of this circulating flow boiling process to produce a variation in boiling pressure, temperature and temperature difference with respect to height in the boiling channel. The important feature of the present invention is the use of two sequential heat transfer zones having different pressure drop and heat transfer characteristics in the same boiling channel. This combination is synergistic in providing a greater heat transfer efficiency than can be achieved by either individual zone.

The first heat transfer zone comprises a higher pressure drop, high-convective-heat-transfer zone with extended secondary fin surfaces. These secondary fin surfaces are installed in the lower non-boiling region of the boiling channel. The length of the finned section will depend upon the thermophysical properties of the liquid, local heat and mass fluxes and heat transfer coefficients. Basically, the length of the finned section should be long enough to completely preheat the liquid to saturation temperature, so the more effective nucleate boiling can occur in the second zone. For a cryogenic reboiler-condenser, this length will be in the range of about 10% to about 60% of the total length of reboiler-condenser, with the optimum being between about 20% and about 40% of the total length.

The second heat transfer zone comprises an essentially open channel with only minor obstruction by secondary surfaces and with enhanced nucleate boiling heat transfer surface and a low pressure drop characteristic. This is typically located in the upper boiling region of the boiling circuit. The enhanced surfaces can be of any type, the invention does not preclude any of the methods of forming an enhanced boiling surface. Nevertheless, it is beneficial to utilize high-performance enhanced surfaces such as a bonded high-porosity porous metal, micro-machined, or mechanically formed surface having heat transfer coefficients three (3) or more times greater than for a corresponding flat plate.

In order to perform the proposed method of boiling liquids, the invention also provides a dual-zone heat exchanger for boiling a liquefied gas by heat exchange. This dual-zone method of flowing liquid boiling, e.g., thermosyphon, may be incorporated into heat exchangers of both the vertical shell-and-tube type and the plate-fin brazed aluminum type, but the latter is a preferred configuration for cryogenic processes since it provides much greater surface area per unit volume of heat exchanger and thus permits lower temperature differences to be economically achieved.

One configuration of the present invention is a tube boiling channel having dual-zone boiling surfaces for a shell-and-tube type of reboiler as shown in FIG. 2. As for the dual-zone boiling surfaces of the tube, the lower portion is internally finned whereas the upper portion has none or few fins, but has an enhanced nucleate boiling surface. In a shell-and-tube reboiler of the type in the present invention, the heat exchanger would be a bundle of these tubes in a shell casing. In this configuration, boiling flow occurs inside the tubes with the heat duty for the boiling supplied by a condensing or other heat exchange medium on the shell side of the exchanger. The fluid to be boilied enters the bottom of a tube as oriented on the drawing and flows upwardly through the tube, first through the internally finned section and then through the enhanced nucleate boiling surface section, and exits at the top of the tube. The boiling fluid enters the boiling passage as a liquid, initiates boiling about at the interface of the two sections and exits from the boiling passage as a gas liquid mixture.

Figure 3:
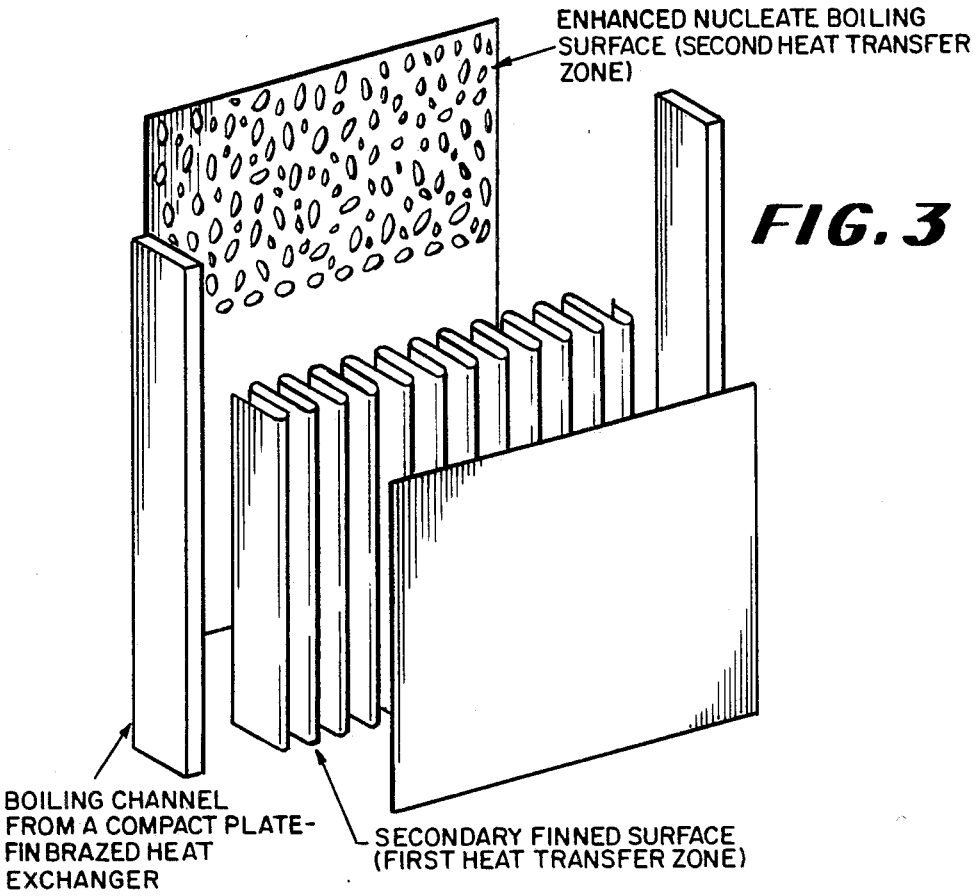
FIG. 3 is an exploded perspective view of a boiling channel in a compact plate-fin brazed heat exchanger showing a first zone with internal fins as the secondary surface and a second zone with an enhanced nucleate boiling surface.

Another configuration of the present invention is a brazed aluminum boiling channel as shown in FIG. 3. As a note of clarification, the front parting sheet of the channel has been shortened to better depict the internal surface of the channel; this parting sheet would be of the same size as the rear parting sheet and would have an enhanced nucleate boiling surface indentical to the rear parting sheet. Like the tube boiling channel of FIG. 2, the lower portion of the passage contains a high-efficiency secondary surface which both promotes high convective heat transfer coefficients and has a high pressure gradient. Various types of secondary fin surfaces may be used, e.g., a serrated fin which, in addition, provides a high transverse open flow area which will redistribute liquid flow in the event of any local obstruction. This is especially helpful in the prevention of hazardous conditions for boiling oxygen in air separation. The upper portion of the boiling passage is open without fins and has enhanced nucleate boiling surface on the parting sheet between boiling and condensing passages. In a brazed reboiler of the type in the present invention, the heat exchanger would be a series of channels used alternately for boiling and condensing service. In this configuration, boiling flow occurs inside a boiling channel with the heat duty for the boiling supplied by the condensing or other heat exchange medium in the adjacent channels of the exchanger. The fluid to be boiled enters the bottom of the boiling channel and flows upwardly through the channel, first through the internally finned section and then through the enhance nucleate boiling surface section, and exits at the top. The boiling fluid enters the boiling passage as a liquid, initiates boiling about at the interface of the two sections and exits from the boiling passage as a gas-liquid mixture. The condensing channel in the present invention may be of conventional design but would preferably be of a design to maximize the efficiency of heat transfer.

To demonstrate its benfits, the proposed method of boiling was studied on a specially constructed Freon-11 thermosyphon reboiler-condenser test apparatus. The purpose of the study was to directly compare an improved plate-fin brazed aluminum reboiler-condenser, i.e. the present invention, and a conventional plate-fin reboiler-condenser. For the study, experimental temperature profiles were measured at equivalent operating conditions for the conventional and enhanced reboiler-condensers. Both of the reboiler-condensers were operated at the same total heat duty and depth of the external liquid bath. The results obtained for the conventional and enhanced reboiler condensers are presented for comparison in FIG. 4*a* and FIG. 4*b* respectively. A comparison of FIG. 4*a* and FIG. 4*b* clearly demonstrates the advantages of the proposed method of boiling.

Figure 4B:
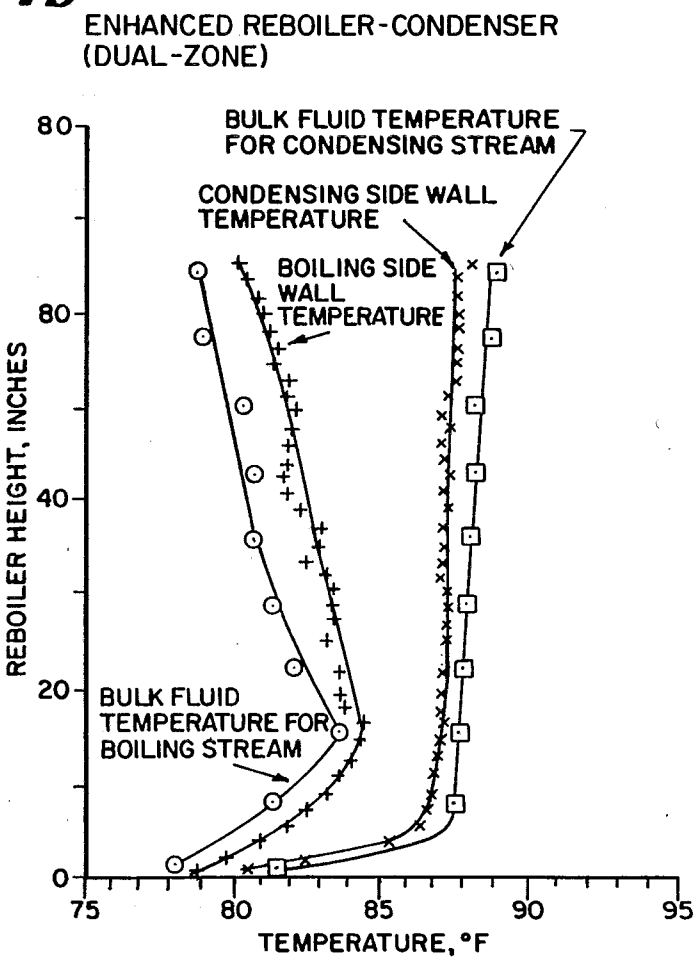
FIGS. 4*a* and 4*b* are plots of the temperature profiles along the length of the boiling channel for the conventional boiler-condenser and the enhanced, dual-zone reboiler-condenser of the present invention respectively.

An initial comparison may be made by examining the overall temperature difference between boiling and condensing fluids at the top of the reboiler-condenser. The enhanced reboiler-condenser, FIG. 4*b*, shows a substantially lower temperature difference than the conventional reboiler-condenser, FIG. 4*a*, 9.8° F. for the enhanced versus 14.2° F. for the conventional. Although this difference in temperature differences shows a key advantage, it is important to examine the individual differences in performance for each heat exchanger.

As background, both experimental heat exchangers were specially constructed to be able to accurately measure the local temperatures and heat fluxes at various points along their vertical height. A very thick parting sheet was used to separate the boiling and condensing passages so that the surface temperatures could be measured and used in conjunction with the thermal conductivity of the metal and a computer solution of the general heat conduction equations to determine the heat flux in the direction perpendicular to the fluid passages. The difference between the boiling wall temperature and the condensing wall temperature is shown in FIG. 4*a* and FIG. 4*b*; this difference is directly indicative of the heat flux.

Similarly, the temperature difference between the bulk fluid, either the boiling fluid or the condensing fluid, and the wall is inversely proportional to the fluid heat transfer coefficient. Therefore, for a location having the same heat flux, the temperature difference between the bulk fluid and the wall is smaller and thus the boiling heat transfer coefficient is larger for the enhanced reboiler-condenser, FIG. 4*b*, than for the conventional reboiler-condenser, FIG. 4*a*.

Figure 4A:
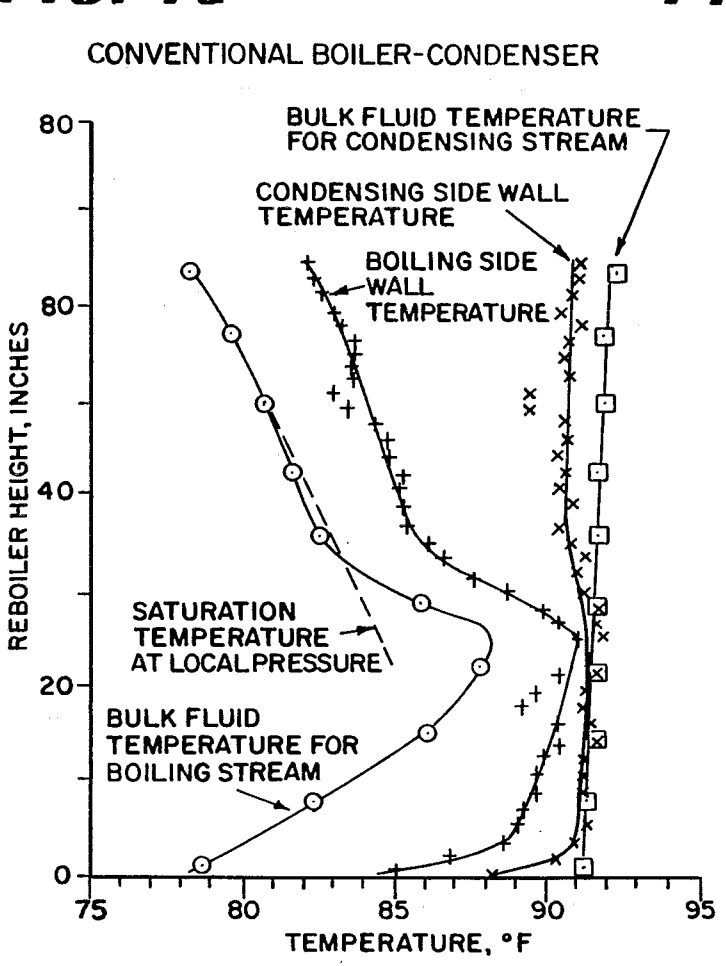

An examination of the boiling fluid temperature profile for the conventional reboiler-condenser, FIG. 4*a*, shows the difference between the measured fluid temperature and the liquid saturation temperature determined from pressure measurements for the same locations. The deviation of the measured temperatures and the liquid saturation temperatures in the lower region of the heat exchanger clearly shows the zone of liquid superheat which does not occur in the enhanced reboiler-condenser, FIG. 4*b*.

The most important result to be demonstrated is the difference in the temperature gradient with respect to height in the boiling zones. For the enhanced reboiler-condenser, FIG. 4*b*, the boiling temperature gradient is 0.97° F./ft whereas for the conventional reboiler-condenser, FIG. 4*a*, the gradient is 2.0° F./ft. This result illustrates the unique benefit of the proposed method of boiling by reducing the variation of boiling temperature with height. The reduced temperature gradient with height exhibited by the upper zone of the enhanced reboiler-condenser, FIG. 4*b*, is the consequence of the lower pressure gradient of this zone and the increased pressure gradient of the serrated fin in the lower zone. Another benefit of this two zone arrangement is the ability to initiate boiling at a lower elevation in the heat exchanger; this benefit is also demonstrated in FIG. 4*b*.

Although not wishing to be bound by any particular theory, the mechanism by which the dual-zone boiling process obtains a performance greater than would be achieved in a single-zone thermosyphon reboiler may be explained as follows:

The circulating boiling liquid flow in a conventional single zone thermosyphon reboiler is generated by the difference in head between the external liquid bath and the head of vapor-liquid mixture in the boiling passage. This difference induces an upward flow in the boiling passage, where the amount of circulating liquid is determined by the quantity of vapor generated, the flow resistance of the boiling circuit and the head of liquid in the external bath.

In a conventional reboiler only a single type of heat transfer surface is present. The pressure gradient through the boiling circuit is relatively uniform since the two major components of pressure gradient compensate each other. The frictional pressure gradient is low in the inlet, single phase non-boiling, region and increases with height as the fraction of vapor increases. Whereas the static head decreases quickly with height in the inlet region and then decreases slowly once boiling has commenced and the vapor fraction of the fluid is high.

The invention acts to improve the efficiency of the reboiler-condenser by changing the pressure relationship with height in the boiling circuit. Thus the lower non-boiling zone of the boiling circuit contains a secondary fin surface with a high frictional pressure drop and a high convective heat transfer coefficient. This lowers the boiling circuit pressure more rapidly than a conventional reboiler and allows boiling to be initiated at a lower temperature and at a lower position in the heat exchanger.

The upper zone of the boiling passage is an essentially open channel with a low frictional pressure drop and a high performance nucleate boiling surface. Thus the lower pressure resulting from the inlet zone can be accepted and still utilize the overall head of liquid available from the external liquid pool without a significant change of liquid circulation rate. The enhanced boiling surface ensures that boiling nucleation is not delayed and maintains a very high heat transfer coefficient.

Figure 5:
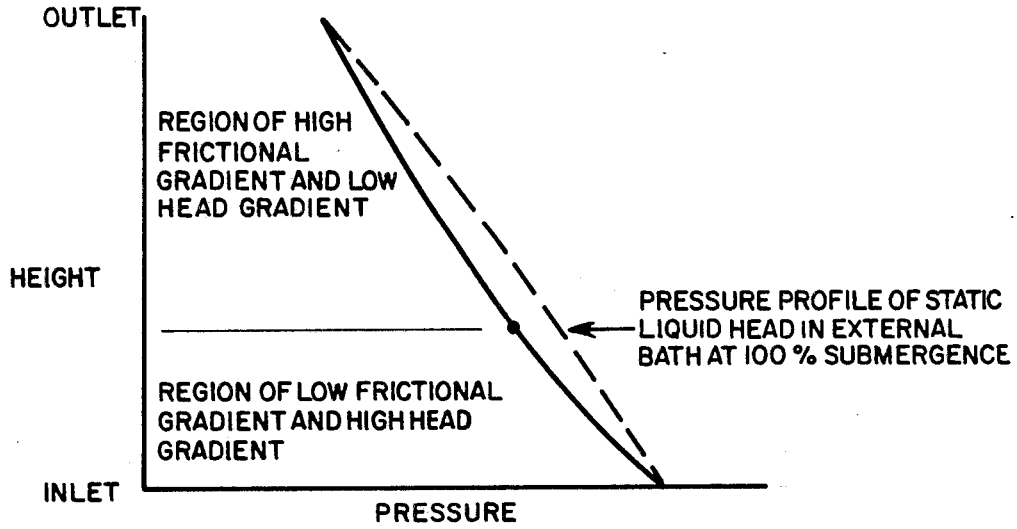
FIG. 5 is a plot of the comparison between the pressure gradients along the length of the boiling channel for the conventional, single zone, reboiler-condenser and the present invention.
Figure 5:
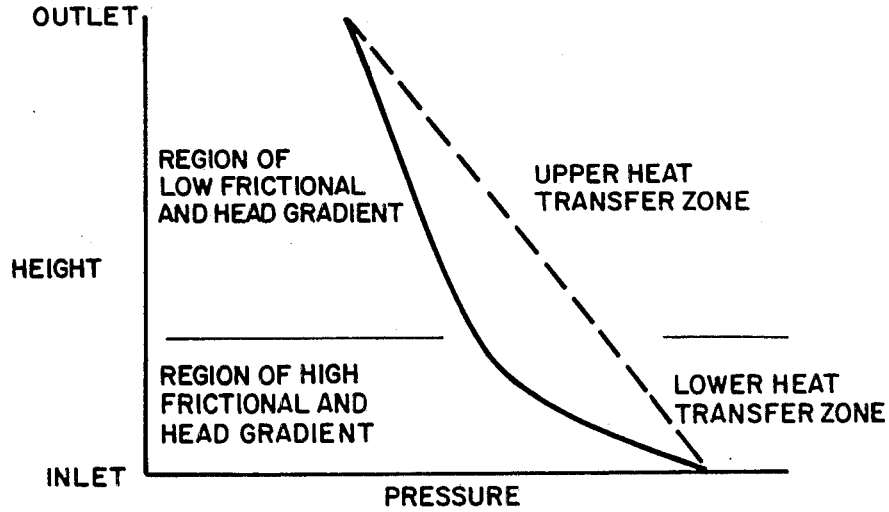

Neither surface when used alone as a single heat transfer zone can obtain the beneficial pressure relationship with height of the dual-zone process as illustrated in FIG. 5.

The present invention has been described with reference to preferred embodiments thereof. However, these embodiments should not be considered a limitation on the scope of the invention, which scope should be ascertained by the following claims.

What is claimed is:

1. In a process for boiling flowing liquids in a heat exchanger wherein said flowing liquid is heated in a single heat exchanger to vaporize said liquid, the improvement of which comprises:

(a) passing said boiling flowing liquid through a first heat transfer zone of said heat exchanger comprising a surface with a high-convective-heat-transfer characteristic and a higher pressure drop characteristic; and then (b) passing said boiling flowing liquid through a second heat transfer zone of said heat exchanger comprising an essentially open channel with only minor obstructions by secondary surfaces, with an enhanced nucleate boiling heat transfer surface and a lower pressure drop characteristic.

2. The process of claim 1 wherein said heat exchanger is a thermosyphon heat exchanger.

3. The process of claim 1 wherein said heat exchanger is a shell and tube heat exchanger.

4. The process of claim 1 wherein said heat exchanger is a plate-fin brazed heat exchanger.

5. The process of claim 1 wherein the length of said first heat transfer zone is in the range of 10 percent to 60 percent of total length of said heat exchanger.

6. The process of claim 1 wherein the length of said first heat transfer zone is in the range of 20 percent to 40 percent of total length of said heat exchanger.

7. The process of claim 1 wherein said enhanced nucleate boiling heat transfer surface is a bonded high-porosity porous metal.

8. The process of claim 1 wherein said enhanced nucleate boiling heat transfer surface is a mechanically formed surface.

9. The process of claim 1 wherein said enhanced nucleate boiling heat transfer surface has a heat transfer coefficient greater than or equal to three times greater than for a corresponding flat plate.

10. The process of claim 1 wherein the length of said first heat transfer zone is that required to completely preheat a boiling liquid to its saturation temperature.

11. A heat exchanger for boiling flowing liquids, the improvement of which comprises the incorporation of two sequential heat transfer zones of different characteristics in a single exchanger, said heat exchanger comprising:

(a) a first heat transfer zone comprising a surface with a high-convective-heat-transfer characteristic and a higher pressure drop characteristic; and (b) a second heat transfer zone comprising an essentially open channel with only minor obstructions by secondary surfaces, with an enhanced nucleate boiling heat transfer surface and a lower pressure drop characteristic.

12. The heat exchanger of claim 11 wherein said heat exchanger is a thermosyphon heat exchanger.

13. The heat exchanger of claim 11 wherein said heat exchanger is a shell and tube heat exchanger.

14. The heat exchanger of claim 11 wherein said heat exchanger is a plate-fin brazed heat exchanger.

15. The heat exchanger of claim 11 wherein the length of said first heat transfer zone is in the range of 10 percent to 60 percent of total length of said heat exchanger.

16. The heat exchanger of claim 11 wherein the length of said first heat transfer zone is in the range of 20 percent to 40 percent of total length of said heat exchanger.

17. The heat exchanger of claim 11 wherein said enhanced nucleate boiling heat transfer surface is a bonded high-porosity porous metal.

18. The heat exchanger of claim 11 wherein said enhanced nucleate boiling heat transfer surface is a mechanically formed surface.

19. The heat exchanger of claim 11 wherein said enhanced nucleate boiling heat transfer surface has a heat transfer coefficient greater than or equal to three times greater than for a corresponding flat plate.

20. The heat exchanger of claim 11 wherein the length of said first heat transfer zone is that required to completely preheat a boiling liquid to its saturation temperature.

21. In a process for the separation of air into its constituent oxygen and nitrogen components, wherein a single heat exchanger is utilized to heat a nitrogen-rich liquid or an oxygen-rich liquid so as to vaporize said nitrogen-rich liquid or oxygen-rich liquid, the improvement comprising:

(a) passing said nitrogen-rich liquid or oxygen-rich liquid through a first heat transfer zone of said heat exchanger comprising a surface with a high-convective-heat-tranfer characteristic and a higher pressure drop characteristic; and then (b) passing said nitrogen-rich liquid or oxygen-rich liquid through a second heat transfer zone of said heat exchanger comprising an essentially open channel with only minor obstruction by secondary surfaces, with an enhanced nucleate boiling heat transfer surface and a lower pressure drop characteristic.

22. The process of claim 21 wherein said heat exchanger is a thermosyphon heat exchanger.

* * * * *